US007692547B2

(12) United States Patent
Appalucci et al.

(10) Patent No.: US 7,692,547 B2
(45) **Date of Patent: *Apr. 6, 2010**

(54) METHOD AND APPARATUS FOR PROTECTING CULINARY PRODUCTS

(75) Inventors: Lawrence Appalucci, Villanova, PA (US); Anthony Piccoli, Audubon, NJ (US); Seth Strauser, Sewell, NJ (US); George West, Swedesboro, NJ (US)

(73) Assignee: Checkpoint Systems, Inc., Thorofare, NJ (US)

( * ) Notice: Subject to any disclaimer, the term of this patent is extended or adjusted under 35 U.S.C. 154(b) by 2 days.

This patent is subject to a terminal disclaimer.

(21) Appl. No.: 12/034,324

(22) Filed: Feb. 20, 2008

(65) Prior Publication Data

US 2008/0150729 A1 Jun. 26, 2008

Related U.S. Application Data

(62) Division of application No. 11/225,417, filed on Sep. 13, 2005, now Pat. No. 7,355,516.

(60) Provisional application No. 60/638,467, filed on Dec. 23, 2004.

(51) Int. Cl.
*G08B 13/14* (2006.01)

(52) U.S. Cl. ..... 340/572.8; 340/572.1; 340/10.1; 343/700 R

(58) Field of Classification Search ..... 340/572.1, 340/572.8, 572.7, 10.1; 343/700 R; 455/41.1
See application file for complete search history.

(56) References Cited

U.S. PATENT DOCUMENTS 4,369,557 A * 1/1983 Vandebult ..... 29/25.42
4,560,445 A 12/1985 Hoover et al.
5,119,070 A 6/1992 Matsumoto et al.
5,142,270 A 8/1992 Appalucci et al.
5,182,544 A 1/1993 Aquilera et al.
5,241,299 A 8/1993 Appalucci et al.
5,754,110 A 5/1998 Appalucci et al.
5,841,350 A 11/1998 Appalucci et al.
5,861,809 A 1/1999 Eckstein et al.
5,902,437 A 5/1999 McDonough et al.
5,963,132 A 10/1999 Yoakum
6,018,298 A 1/2000 Endo et al.
6,031,458 A 2/2000 Jacobsen et al.
6,087,940 A 7/2000 Caperna et al.

(Continued)

FOREIGN PATENT DOCUMENTS

FR 2742251 6/1997

(Continued)

*Primary Examiner*—Toan N Pham
*Assistant Examiner*—Kerri McNally
(74) *Attorney, Agent, or Firm*—Caesar, Rivise, Bernstein, Cohen & Pokotilow, Ltd.

(57) ABSTRACT

A microwave-resistant and waterproof security tag for use with food products, especially meat products. The security tag includes a pair of single, open loop conductive traces in between which is disposed a similarly-shaped dielectric layer. This combination is encapsulated within plastic membranes or covers that are sealed at their common edges. The preferred embodiment includes rectangularly-shaped single, open loop conductive traces with rounded corners and with one end of each trace forming a capacitor plate. The width of each trace is at least 1/10 of the length of the security tag.

9 Claims, 5 Drawing Sheets

U.S. PATENT DOCUMENTS

| | | | | |
|---|---|---|---|---|
| 6,091,607 | A | 7/2000 | McKeown et al. | |
| 6,121,880 | A | 9/2000 | Scott et al. | |
| 6,133,835 | A | 10/2000 | De Leeuw et al. | |
| 6,144,301 | A | 11/2000 | Frieden | |
| 6,262,663 | B1 | 7/2001 | Altwasser et al. | |
| 6,262,692 | B1 | 7/2001 | Babb | |
| 6,265,977 | B1 | 7/2001 | Vega et al. | |
| 6,278,341 | B1 | 8/2001 | Lindqvist | |
| 6,278,371 | B1 | 8/2001 | Hopkins | |
| 6,400,271 | B1 | 6/2002 | Davies, Jr. et al. | |
| 6,407,669 | B1 | 6/2002 | Brown et al. | |
| 6,441,736 | B1 | 8/2002 | Leighton | |
| 6,478,229 | B1 | 11/2002 | Epstein | |
| 6,496,113 | B2 | 12/2002 | Lee et al. | |
| 6,645,327 | B2 | 11/2003 | Austin et al. | |
| 6,724,310 | B1 * | 4/2004 | Gershenfeld et al. | 340/572.4 |
| 6,940,408 | B2 | 9/2005 | Ferguson et al. | |
| 6,982,640 | B2 * | 1/2006 | Lindsay et al. | 340/540 |
| 7,176,799 | B1 | 2/2007 | Golicz et al. | |
| 2001/0003438 | A1 | 6/2001 | Imaichi et al. | |
| 2002/0067268 | A1 | 6/2002 | Lee et al. | |
| 2002/0135481 | A1 | 9/2002 | Conwell et al. | |
| 2002/0163434 | A1 * | 11/2002 | Burke | 340/572.7 |
| 2003/0169153 | A1 | 9/2003 | Muller | |
| 2005/0001723 | A1 | 1/2005 | Takei | |
| 2006/0007004 | A1 | 1/2006 | Altwasser | |
| 2006/0022828 | A1 | 2/2006 | Prat et al. | |
| 2006/0164312 | A1 | 7/2006 | Mathieu | |
| 2006/0255952 | A1 | 11/2006 | Waegner | |

FOREIGN PATENT DOCUMENTS

| | | |
|---|---|---|
| WO | 00/47410 | 8/2000 |
| WO | 01/31601 | 5/2001 |

* cited by examiner

FIG.4
(PRIOR ART)
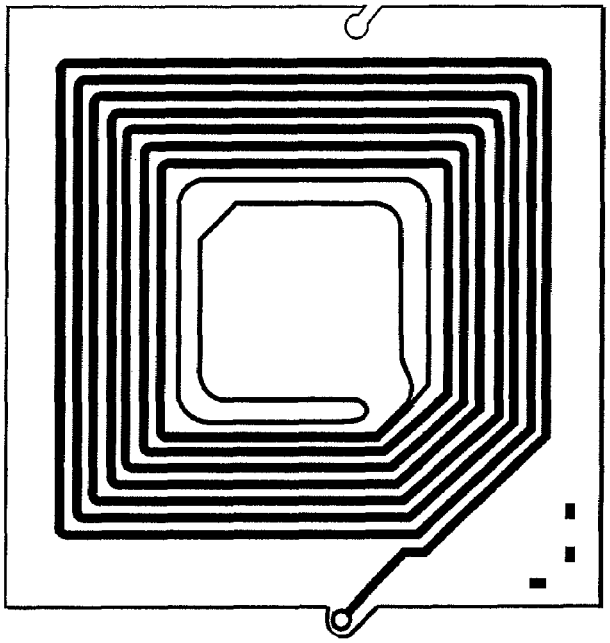
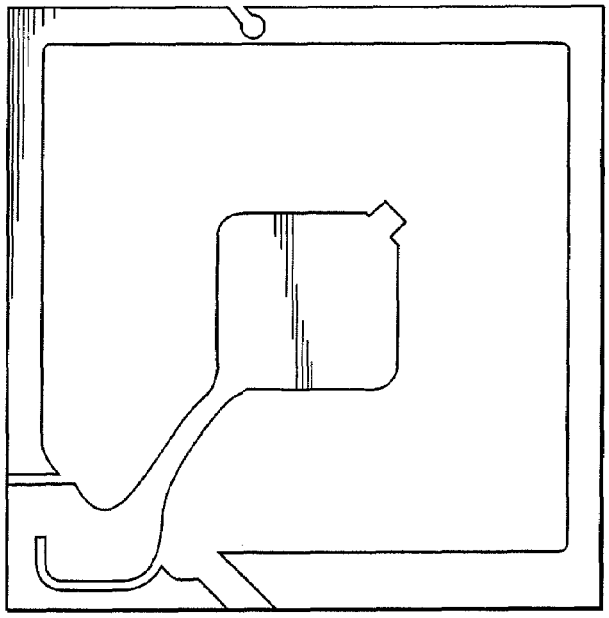
FIG.5
(PRIOR ART)

METHOD AND APPARATUS FOR PROTECTING CULINARY PRODUCTS

CROSS-REFERENCE TO RELATED APPLICATIONS

This divisional application claims the benefit under 35 U.S.C. §121 of utility application Ser. No. 11/225,417 filed on Sep. 13, 2005, which in turn claims the benefit under 35 U.S.C. §119(e) of Provisional Application Ser. No. 60/638,467 filed on Dec. 23, 2004, all of which are entitled METHOD AND APPARATUS FOR PROTECTING CULINARY PRODUCTS and all of whose entire disclosures are incorporated by reference herein.

BACKGROUND OF THE INVENTION

1. Field of Invention

The current invention discloses a security tag for use with food items that are sold. This invention is specifically designed for foods such as meats, fish, and delicatessens. However, it is envisioned this security tag can be used with any food product.

2. Description of Related Art

Examples of security tags for products are shown in U.S. Pat. No. 5,142,270 (Appalucci, et al.); U.S. Pat. No. 5,182,544 (Aquilera, et al.); U.S. Pat. No. 5,754,110 (Appalucci, et al.); U.S. Pat. No. 5,841,350 (Appalucci, et al.); U.S. Pat. No. 5,861,809 (Eckstein, et al.) and U.S. Pat. No. 6,400,271 (Davies, Jr., et al.). In particular, another patent owned by Checkpoint System, Inc. of Thorofare, N.J. is U.S. Pat. No. 5,241,299 (Appalucci, et al.), which is incorporated by reference herein, and which discloses an RF (Radio Frequency) tag that has a polymeric layer sandwiching an RF circuit. This tag's coating provides both protection to the circuitry from water and shock. As can be appreciated by those skilled in the art, the purpose of the security tag is to activate security alarms in the store should a customer attempt to leave the store without purchasing the product. If the item is purchased, the security tag is deactivated (usually at the point of sale) to prevent setting off the alarms when the customer leaves the store; thus, the functional life of the security tag is completed.

Food products sold by stores also now include such security tags and many of these food products are microwavable. To prevent the customer from microwaving the deactivated security tag, a warning is typically provided that instructs the customer to discard the packaging before microwaving the food product. However, where the customer forgets or ignores the warning, or where the security tag is located somewhere other than the outside packaging (e.g., in the tray of a meat product), it is desirable to provide a security tag that enhances microwave safety.

With particular respect to meat products, recent occurrences of mad cow disease now make the tracking of meat products even more important. Thus, there is a need for providing RFID tags that can properly operate with regard to meat packaging.

All references cited herein are incorporated herein by reference in their entireties.

BRIEF SUMMARY OF THE INVENTION

A security element that is microwave-resistant wherein the security element comprises: a first conductive trace (e.g., aluminum, copper, etc.) forming a single open loop; a second conductive trace (e.g., aluminum, copper, etc.) forming a single open loop; a dielectric layer (e.g., a polymer) forming a single open loop and positioned between the first and second conductive traces; wherein the first and second conductive traces are electrically-coupled at a location that penetrates the dielectric layer; and wherein the first conductive layer, the second conductive layer and the dielectric layer are encapsulated within plastic layers (e.g., polypropylene).

A method for providing a security tag associated with meat or fish product packaging having a soaker pad therein. The method comprises the steps of: providing a security tag that is encapsulated to be waterproof and wherein the security tag includes a pair of single open loop conductive traces that are separated from each other by a dielectric layer and wherein the first and second conductive layers are electrically coupled at a location through the dielectric layer; and disposing the security tag within the soaker pad.

A method for providing a security tag associated with meat or fish product packaging having a label thereon. The method comprises the steps of: providing a security tag that is encapsulated (e.g., sealed within plastic layers) to be waterproof and wherein the security tag includes a pair of single open loop conductive traces (e.g., aluminum, copper, etc.) that are separated from each other by a dielectric layer (e.g., a polymer) and wherein the first and second conductive layers are electrically coupled at a location through the dielectric layer; applying an adhesive to one side of the security tag; and securing the security tag on the label.

A method for testing a security tag to determine if it is microwave-resistant. The method comprising the steps of: (a) providing sample food products (e.g., meat products such as beef, chicken, pork, or fish, etc.) that are packaged in a conventional manner and includes associating the security tag under test with each of the sample food products packages; (b) subjecting the sample food products to cold temperatures (e.g., freezing, partially frozen, refrigeration, etc.) for a predetermined period of time (e.g., 24-48 hours);

(c) placing each of the sample food product packages along with their respective security tags under test into respective microwave ovens; (d) activating each of the microwave ovens on high power for three minutes and wherein each microwave has a respective microwave configuration (e.g., 800 watts/0.8 $ft^3$, 1000 watts/1.2 $ft^3$ and 1200 watts/1.6 $ft^3$); (e) observing the sample food products being heated in the microwave ovens to see if any sparking or arcing occurs during heating; (f) repeating steps (d) and (e) for a predetermined number of times (e.g., eighty); and (g) determining that said security tag is microwave resistant if no sparking or arcing occurs after completing step (f).

BRIEF DESCRIPTION OF SEVERAL VIEWS OF THE DRAWINGS

The invention will be described in conjunction with the following drawings in which like reference numerals designate like elements and wherein:

FIG. 4 is an enlarged front view of a prior art Series 410 tag;

FIG. 5 is an enlarged rear view of the Series 410 tag of FIG. 4;

DETAILED DESCRIPTION OF THE INVENTION

One of the key features of the tag 20 of the present invention is that it enhances microwave safety. Since the current tag 20 is envisioned to be used in the culinary art, it is necessary that the tag be resistant to microwave energy. As mentioned earlier, it is envisioned that customers may accidentally place this tag in their microwave ovens which may create a safety hazard. In particular, as is known, microwave ovens emit microwave energy which will induce an electric current through a circuit within the microwave field. In the case of a security tag, the current will be induced along the antenna trace. When the voltage becomes great enough the electric current can arc across the antenna traces creating sparks, heat, and possibly fires. The tag 20 of the present invention addresses this problem to create a microwave safe tag that can function after being exposed to microwave energy.

In addition to generating a microwave safe tag, the tag has several unique uses. The tag of the current invention can be created with plastics of varying rigidity and melting temperatures. Different plastics have varying advantages in terms of safety, flexibility, and cost. Polypropylene is the preferred material for the tag.

The tag 20 of the present invention is designed to work with foods of all types. A major reason RF tags have not become commonplace in the food retail industry is many tags contain toxic chemicals. The tag 20 of the present invention is devoid of any such materials. One preferred use of this tag is in the meat packing industry. The tag 20 can potentially be packaged with the meat by placing onto the foam meat tray. Additionally, the tag 20 may be attached to a plastic wrap of the food product, e.g., the wrap that surrounds and protects the meat and tray. In addition to the meat packing industry, this tag 20 can be used with any food product whether or not the food can be microwaved. Non-limiting examples of some of these uses are in cereal, candy, dairy, products, chips, and noodles.

The tag 20 is non-toxic, even when heated. Moreover, the tag 20 uses plastic materials which do not emit noxious fumes when heated, do not form noxious liquids when melted, and do not contaminate foods in any manner. The materials used to construct the tag are F.D.A. approved materials for use with food products. In the event the tag is heated in a conventional oven, the tag will melt slightly and become inactive, but will not damage the food.

As will be discussed in detail later, the tag 20 of the current invention also has a polymeric layer sandwiching an RF circuit. Finally, depending on the plastic chosen the tag of the current invention is water-resistant or waterproof.

Figure 2A:
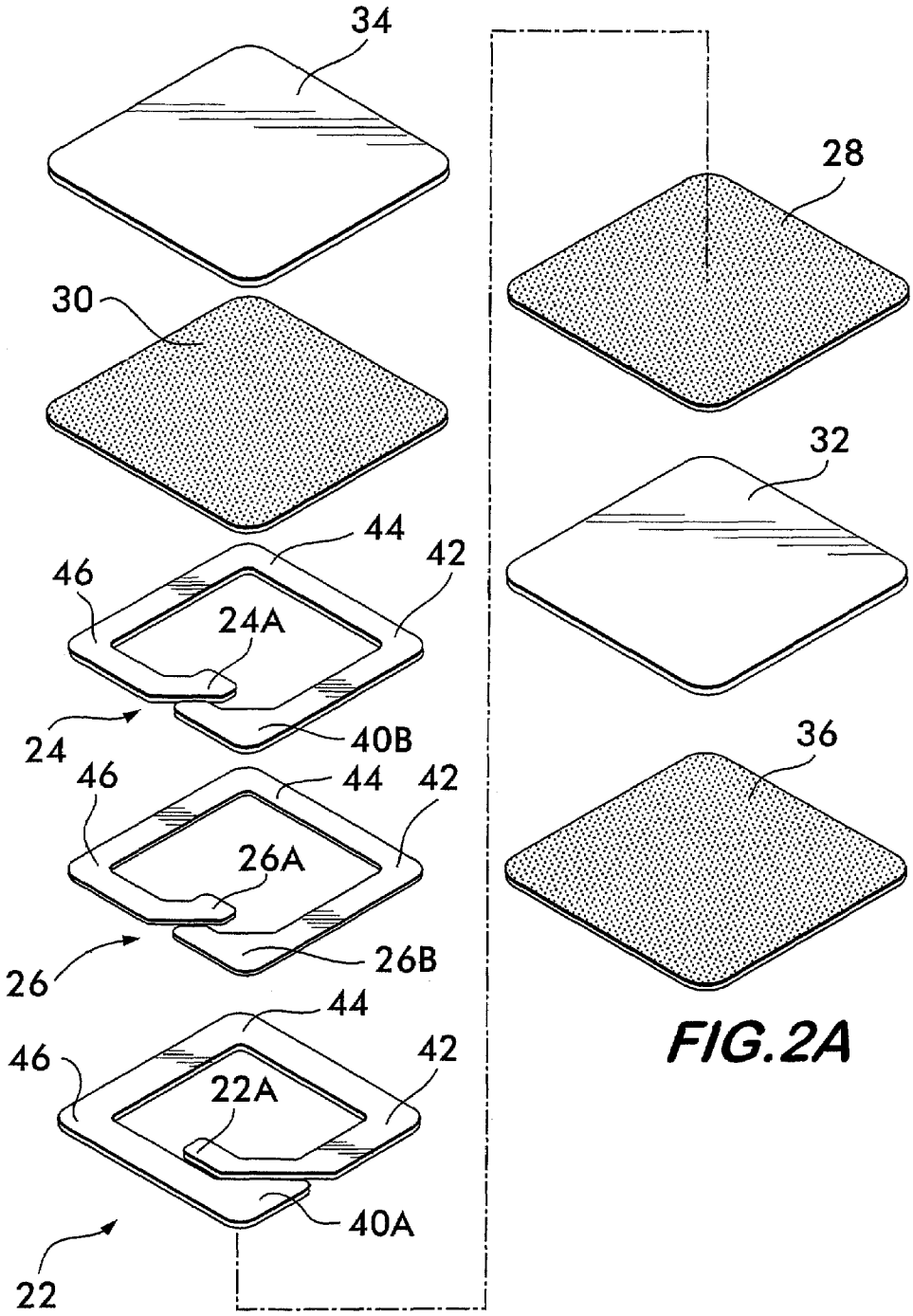
FIG. 2A is an exploded view of the tag of FIG. 1.

As shown most clearly in FIG. 2A, the tag 20 comprises a first coil layer 22 comprising a single open loop and a second coil layer 24 also comprising a single open loop that are separated by a dielectric layer (e.g., any polymer) 26 that matches the shape of the first and second coil layers 22/24. The term "single open loop" means that the trace forms only one loop (e.g., there are no concentric inner or outer coil loops as there are in FIG. 4); and whereby the trace has endpoints that are not connected; these coil layers may comprise any conductive material, preferably aluminum, copper, etc. First 28 and second 30 adhesive layers are then applied to the respective coil layers 22/24. Polypropylene layers 32 and 34 are secured around the tag 20 by the adhesive layers 28/30. Finally, a third adhesive layer 36 is provided so that the tag 20 can be secured to a portion of the wrapping/packaging of the food product. The first and second coil layers 22/24 are electrically-coupled at contact points 22A and 24A by a crimping action that pierces the dielectric layer at region 26A. To make up for the lower inductance value of the coil layers 22/24 since they each only comprise a single open loop, large capacitor plates 40A and 40B are used; region 26B of the dielectric layer 26 forms the dielectric between these capacitor plates 40A/40B. It should be understood that the majority of the capacitance is distributed capacitance that is provided by the combination of the single open loop conductive traces 22/24 sandwiching the dielectric layer 26; the large capacitor plates 40A/40B provide a tuning provision for the tag 20.

Figure 1:
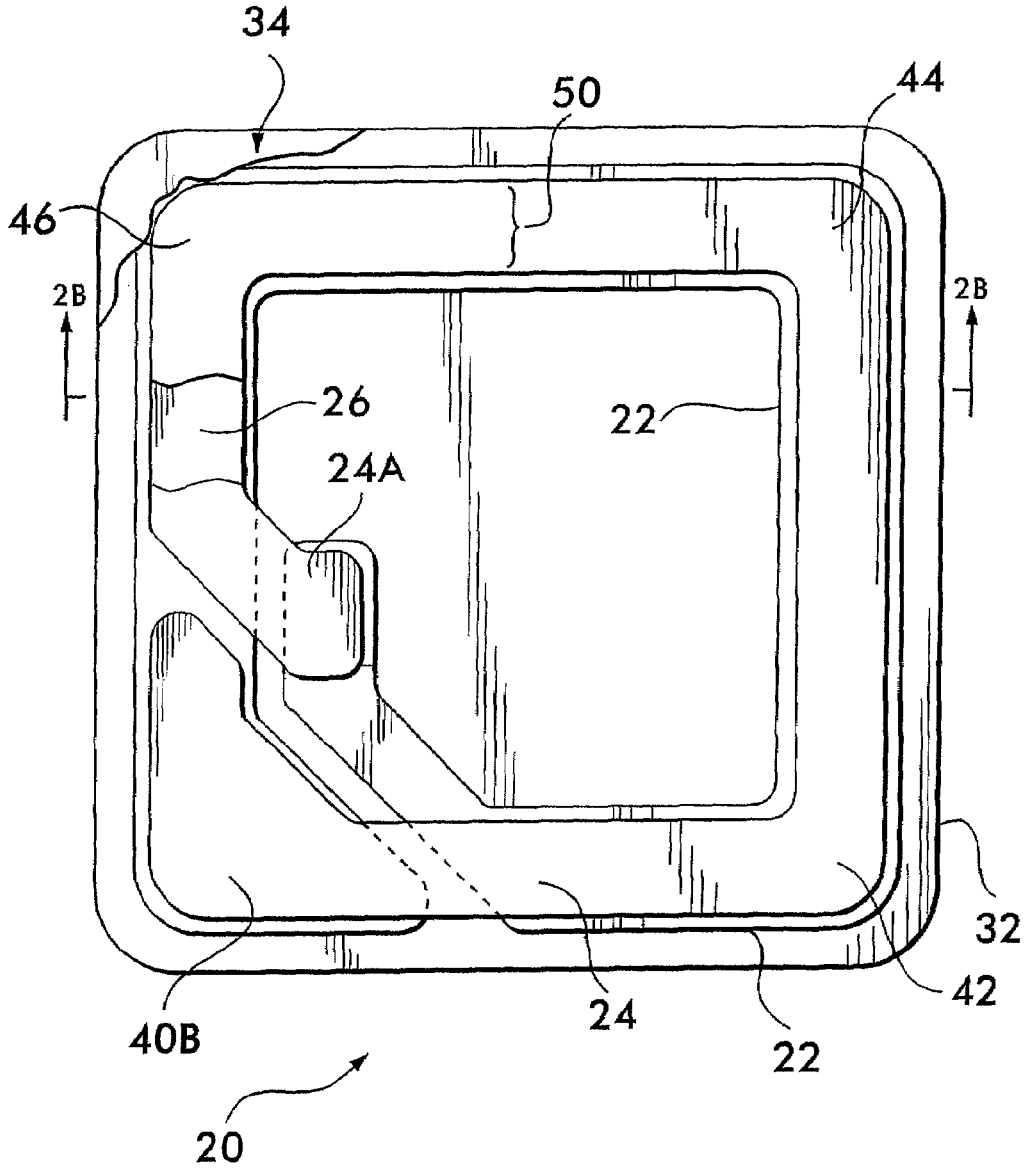
FIG. 1 is an enlarged, partial plan view of the culinary tag of the present invention with the upper adhesive layer omitted.
Figure 2B:
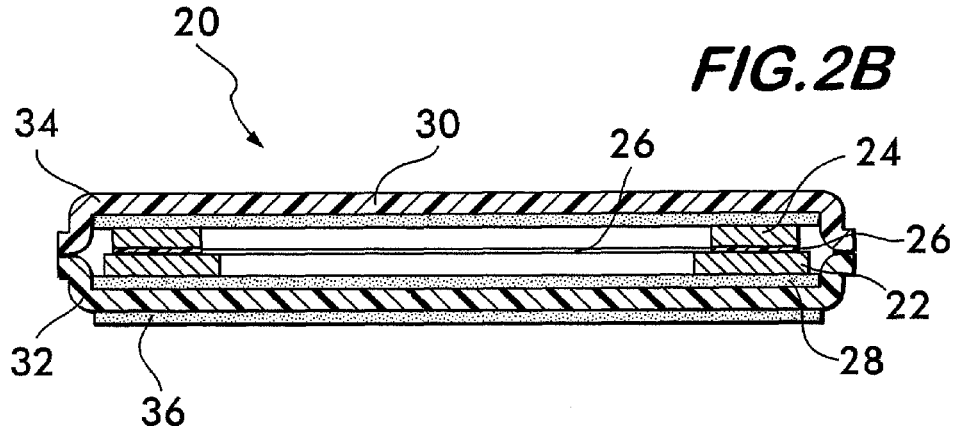
FIG. 2B is a cross section view of the tag of FIG. 1 taken along line 2B-2B.

As shown most clearly in FIG. 1, each coil layer trace 22/24 comprises three elbows 42, 44 and 46 and is connected to a respective capacitor plate 40B and 40A, respectively. An elbow 42, 44 and 46 is defined as a change in direction of the trace of at least 60 degrees. By way of example only, the elbows 42, 44 and 46 typically have a radius of curvature of 0.15 in. Each of the capacitor plates 40A and 40B form a fourth elbow of the respective coil layer trace (22/24), thereby giving the traces 22/24 a square appearance. As mentioned earlier, the pair of traces 22/24 are separated by a dielectric layer 26. As mentioned earlier plastic membrane or layers 32/34 encapsulate the tag 20. Multiple methods can be used to form these layers 32/34 onto the tag 20 including using adhesives 28/30 to bond two plastic pieces 34/36 together to surround the tag 20, melting two pieces of plastic together to surround the tag 20, and molding the plastic around the tag 20. In the first two methods, a seal is formed around the edges of the plastic to prevent water from entering the circuit. This can be seen most clearly in FIG. 2B where the plastic layers 34/36 comprise an overlap that is sealed together.

Many plastics can melt or produce noxious fumes when microwaved. Polypropylene is one preferred material for the tag 20 of the present invention because it is a FDA-approved material suitable to be used in conjunction with microwavable foods. Another advantage of polypropylene is that it is flexible and can be used in lamination devices easily. Depending on the attributes needed, various plastics could be substituted for polypropylene. Some uses of this tag 20 may require a more flexible or rigid plastic, or one providing more waterproofing capabilities.

It should be noted that although a somewhat rectangular configuration for the coil layers 22/24 are used, it is within the broadest scope of the present invention to include any shape of a single trace.

The tag 20 of the present invention was originally designed for use with the meat packing industry. Meat is an expensive product in retail stores and has widely not been successfully protected by RF technology. The delicate RF circuitry does not work if it is exposed to blood or water. Additionally, most conventional tags cannot produce a strong enough signal when covered with the meat product. The plastic casing (e.g., layers 32/34) of the tag 20 provides a novel solution to this problem and allows the tag 20 to be hidden in the soaker pad (also known as "towelette") found under most meat products. It is contemplated that this tag 20 could be placed adjacent the towelette. Additionally, meat products without towelettes can be protected. The general method for packaging the meat product is therefore encapsulating a tray, the tag, the towelette, and the meat with a plastic wrap. The most preferred embodiment is having the wrap sealing the meat in the tray, with a tag on the top of the wrap.

Figure 3:
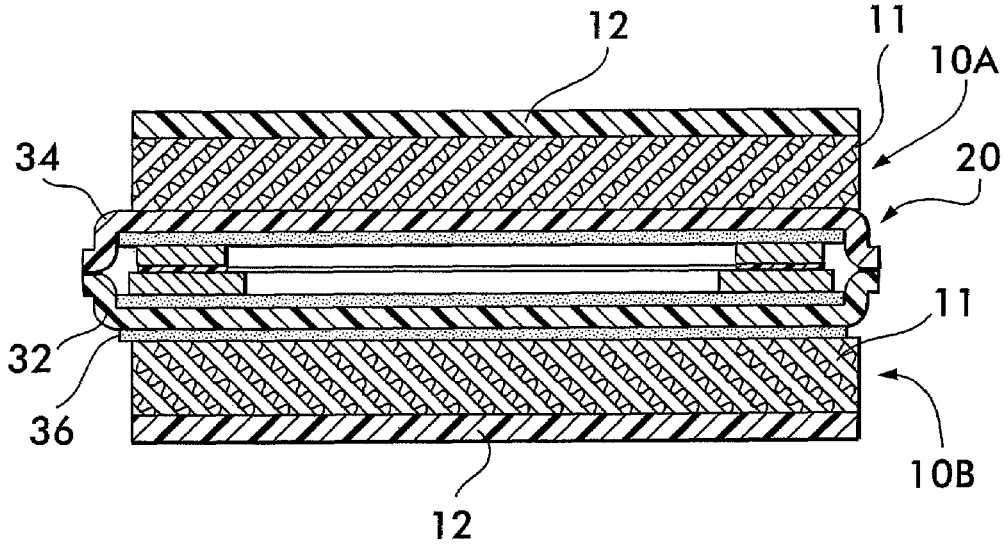
FIG. 3 is a cross-sectional view of the culinary tag of the present invention inserted within a soaker pad of a food (e.g., meat) package.
Figure 6:
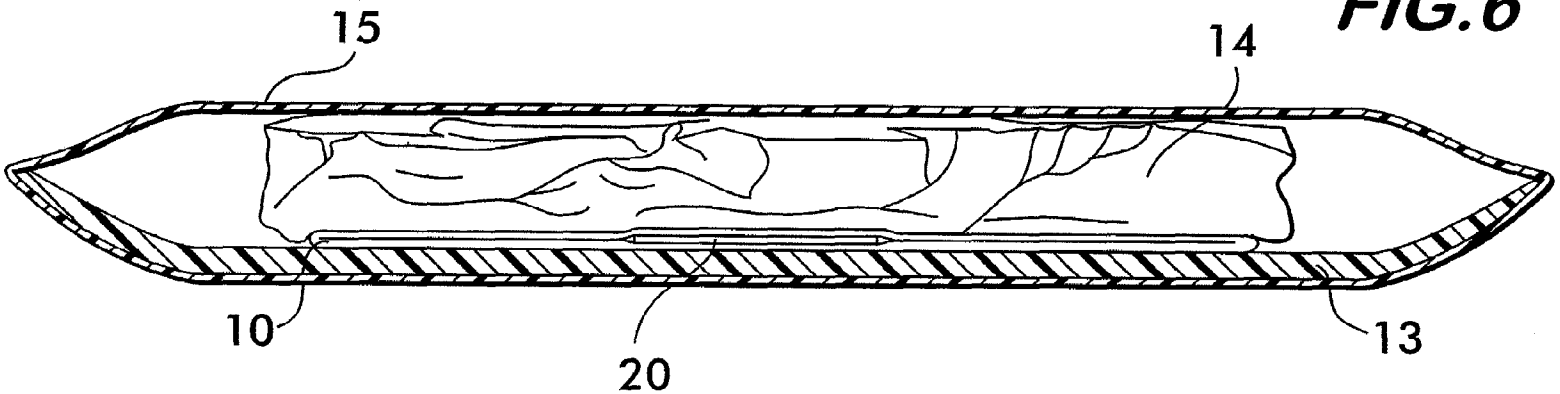
FIG. 6 is a side view of a food package showing the culinary tag positioned inside the soaker pad of a meat package.
Figure 7:
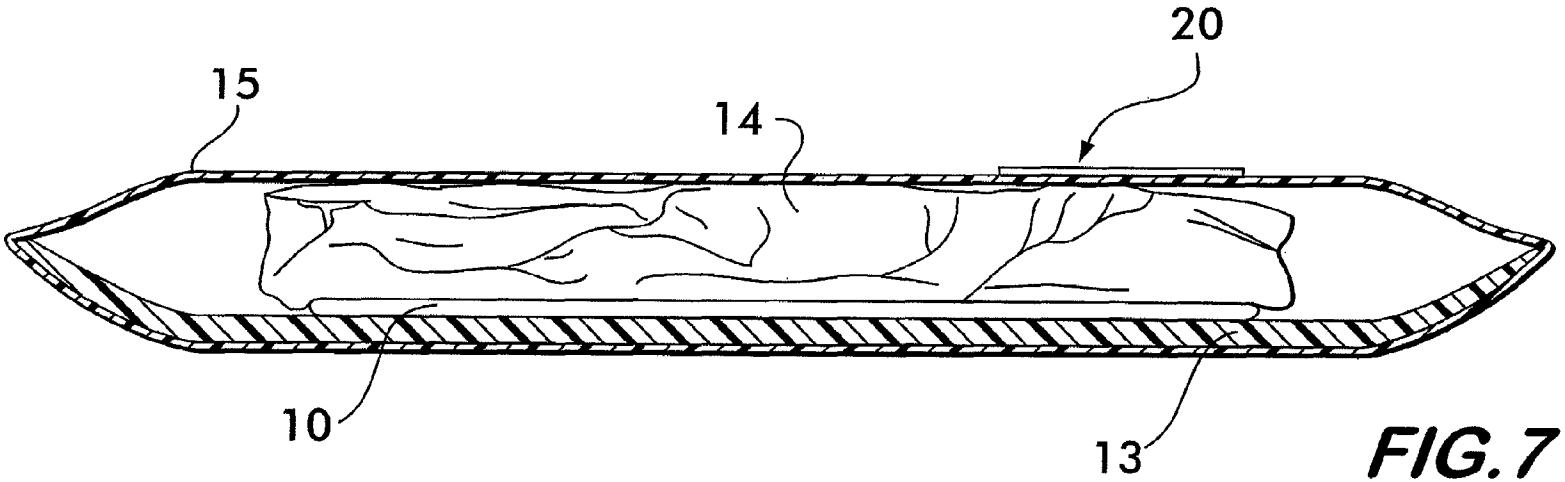
FIG. 7 is a side view of a food package showing the culinary tag positioned in an alternative location such as on the wrap of the food package.

In particular, FIG. 3 depicts the tag 20 positioned in between a soaker pad 10 that is formed by an upper portion 10A and a lower portion 10B. Each soaker pad portion comprises an absorbent paper layer 11 in contact with the polypropylene layers 32 and 34. The absorbent paper layer 11 is then covered by a perforated polypropylene layer 12. FIG. 6 provides an overall view of a packaged meat product showing the position of a soaker pad 10 including the tag 20 of the present invention disposed therein. In particular, the soaker pad 10 is positioned inside a tray (e.g., polystyrene) or holder 13. The meat product 14 is then placed on top of the soaker pad 10. A transparent cover (e.g., cellophane or shrink wrap, etc.) 15 is then secured over the meat product 14 and sealed to the tray 13. Alternatively, the tag 20 may comprise a part of the label that specifies the product details for the customer; the label is typically bonded (e.g., adhesively-secured) to the transparent cover 15. In particular, the tag 20 may be adhesively secured to the label (or alternatively, may be formed as a part of the label, etc.), as shown in FIG. 7.

The tag of present invention can be used to protect other products that are currently very difficult to protect because of moisture, health concerns, or microwave safety. An embodiment of this tag can be created with a waterproof seal that allows that tag to remain submerged in a liquid, such as wine or milk. This would provide a tag that cannot be removed, while providing all the benefits of RF protection, and without damaging the product.

It is additionally contemplated that tags of this invention can be used in dairy products, cereal, frozen foods, bread, and pastas. While these foods can be protected by using conventional RF technology, limitations of those tags prevented the tags from being placed in direct contact with the food because of signal strength problems, health problems, or microwave safety. The tags of the current invention fulfill the long-felt need to solve these problems, and can effectively protect consumable items in a way not previously possible.

The preferred dimensions of the tag 20 are selected to give maximum output of the tag 20 while solving the four problems surrounding the RF food protection industry. These problems are microwave safety, waterproof capability, protection of the food from tag contamination, creation of a tag that can minimize the effects of RF interference caused by the food. The following dimensions are disclosed by way of example only, and in some cases the dimensions could be modified in order to satisfy particular food product needs but without deviating from the scope of the invention. The dimensions of the tag 20 are approximately 1.72 inches by 1.72 inches. The width (also referred to as "line width") of the first coil layer 22 is approximately 0.20 inches; the line width of the second coil layer 24 is approximately 0.26 inches. The conductive trace (i.e., coil layer) width should be at least 1/10 of the length of the tag 20. The capacitor area is 0.2191 square inches. The thickness of layer 24 is approximately 50 microns and the thickness of the layer 22 is approximately 38 microns. The thickness of the dielectric layer 26 is approximately 2.5 microns. By way of example only, the frequency the tag 20 returns the resonant signal is 8.2 MHz. The Q of the tag ("quality factor," which is a measure of frequency selectivity or sharpness of the peak of a resonant circuit) is approximately 88-90.

To verify the strength of the tag's response signal, the assignee of this application, namely, Checkpoint Systems, Inc., of Thorofare, N.J., has established a "gold standard" or reference which one can compare the performance of the tag 20 of the present invention. In particular, the gold standard is the measure of a transceiver's measured signal strength of a Series 410 tag, sold by Checkpoint Systems, Inc. (see Table 1, as well as FIGS. 3-4) versus the tag 20 of the present invention. Typically, an RF tag returns a certain EM-field when it is energized by a transmitter. The strength of a magnetic field is measured in Gauss or Teslas. The magnetic field generated by the tag induces a current across an inductor which resides in the antenna of the receiver. The induced current is run across a load which creates a voltage difference across the load. This voltage should be approximately 1 GST (gold standard tag) for a series 410 tag.

The tag of the current invention generates a signal 1.7 times more powerful than the Series 410 tag. Thus the tag 20 of the current invention has a power of 1.7 GST because the transceiver measures a 1.7 voltage difference for this tag and 1.0 GST for a series 410 tag.

TABLE 1

| CHECKPOINT SYSTEMS, INC. #410 TAG |
|---|
| Front Area Etched = .5807 sq. in |
| Back Area Etched = 1.6814 sq in. |
| Design Frequency = 8.4 MHz |
| Final Frequency = 8.2 MHz |
| Q Range = 70-75 |
| Capacitance 141.2 pF |
| Inductance = 2.495 μH |
| number of turns = 8 |
| Coil line width = .034 in. |
| Spacing between coils = .01 in. |
| Width of margins = .1 in. |
| Circuit Dimensions = 1.55 in. × 1.65 in. |

As mentioned earlier, one of the key features of the tag 20 of the present invention is that enhances microwave safety. Currently, if a tag is placed inadvertently inside of a microwave oven (e.g., the user forgets to remove the food packaging which contains the security tag), the tag will be energized by the applied microwaves. Energy is stored in the tag's capacitor and throughout the traces (the antenna.) Because the traces have a resistance (though minor) there is a voltage difference between one trace and another. If the tag receives a large amount of energy, as it would if it were microwaved, the small distance between the traces and large voltage difference may cause electric arcing to occur. This can lead to fires if the electrical arc comes near or into contact with a flammable substance. To prevent this from happening, the tag 20 of the present invention is designed to have only one trace. To account for the loss in surface area of the trace, a very thick trace 50 (FIG. 1) is used. To further reduce arcing, the elbows 42-46 of the layers 22/24 are rounded rather than pointed.

Microwave energy is characterized as "high intensity" which is defined as energy greater than 1100 watts, and prolonged exposure greater than four minutes (limited exposure is a time of less than three minutes). For a tag to be considered "microwave safe" it cannot emit sparks when subjected to high power, prolonged microwave energy. When the tag 20 of the current invention is described as being "microwave resistant", this means that the tag 20 continues to operate after exposure of a limited duration of high power microwave energy when used with its intended purpose.

To demonstrate that the security tag 20 of the present invention enhances microwave safety, the Assignee of the present invention engaged a testing and certification company, namely, TÜV Rheinland of North America of Youngsville, N.C., a certification company, to prepare a novel test of the tag 20 of the present invention. It is believed that before then, there was no standard test for the microwave safety of a security tag.

The microwave test involves using different styles of meat that are cut into 0.5 lb (beef) and 1 lb (pork & chicken); the poundage being determined by the amount of moisture content within that particular meat. The tag 20 of the present invention is placed on the outside or inside the soaker pad of each meat package and then they are packaged using Styrofoam meat trays and shrink-wrap. The packages are then placed in a freezer for a 24-48 hour period. Every cut and style of meat has a minimum of 3 duplicates (one for each type of microwave). The meat product including the tag 20 on the label is then placed in (three packages, same weight, cut & style) and is placed into three different microwaves (see microwave types & power levels below) for 3 minutes on high power (i.e., the maximum power level of the microwave oven). The test is considered a success, if after 3 full minutes at high power in the microwave the tag 20 of the present invention has not arced or sparked. This test is performed roughly 80 times per microwave type (3 types see below) or 240 total tests.

1) Microwave Oven Wattage/cu ft—all testing must be performed using each of the following microwave specifications (or configuration):
   A) 800 watts/0.8 cu ft (GE microwave oven)
   B) 1000 watts/1.2 cu ft (Sharp microwave oven)
   C) 1200 watts/1.6 cu ft (Panasonic microwave oven)
2) Type of Meat—all 3 types of meat listed below must be used in all of the testing.
   A) Beef
   B) Chicken
   C) Pork
3) Style of Meat—all 3 styles of meat listed below must be used in all of the testing
   A) Solid Mass
      1) Beef—Filet, Beef Patties, Roast
      2) Chicken—Boneless Breast, Cutlets
      3) Pork—Tenderloin, Roast, Boneless Chops
   B) Small Pieces
      1) Beef—Cubes, Shish Ka Bob
      2) Chicken—Nuggets, Wings
      3) Pork—Sausage
   C) Meat with Bones
      1) Beef—T-Bone, NY Strip, Ribeye
      2) Chicken—Legs, Wings, Breast
      3) Pork—Ribs
4) State of Food
   A) Frozen
   B) Partially Frozen
   C) Refrigerated
5) Weight of Food
   A) 0.5 lbs with Beef when security tag is on the outside of the packaging
   B) 1 lb with Pork and Chicken when security tag is on the outside of the packaging
   C) 0.5 lbs with Beef, Chicken or Pork when security tag has been integrated into a meat soaker pad
6) Location of Security Tag
   A) Underneath Barcode (Outside)
   B) Corners (upper right, lower right, upper left, lower left)
   C) Middle of Package (Outside)
   D) Underneath Meat (Soaker Pad)
7) Power Level
   A) High Power It should be understood that the security tag microwave-resistant testing was conducted using meat food products. However, it is within the broadest scope of the present invention that a similar test method can be applied to other food products, such as fish (0.5 lb), shellfish, etc.

While the invention has been described in detail and with reference to specific examples thereof, it will be apparent to one skilled in the art that various changes and modifications can be made therein without departing from the spirit and scope thereof.

What is claimed is:

1. A method for providing a security tag associated with meat or fish product packaging having a soaker pad therein and a label on the packaging, and wherein said method minimizes a risk of the security tag arcing if the meat or fish product packaging is placed within a microwave, said method comprising:

forming a first single open loop conductor having rounded corners using a first conductive trace on a substrate;

positioning a single open loop dielectric layer on top of said first conductive trace;

positioning a second conductive trace comprising a second single open loop conductor having rounded corners on top of said dielectric layer;

electrically-coupling said first and second conductive traces by penetrating said dielectric layer at a given location; and encapsulating said first conductive layer, said dielectric layer and said second conductive layer within plastic layers.

2. The method of claim 1 further comprising a step of positioning said security tag within the soaker pad.

3. The method of claim 1 further comprising a step of securing said security tag to the label on the packaging.

4. The method of claim 1 wherein said steps of forming a first single open loop conductor and a second single open loop conductor having rounded corners comprises forming at least three rounded corners in said first conductive trace and said second conductive trace.

5. The method of claim 4 wherein said step of forming at least three rounded corners in said first and second conductive traces comprises forming four rounded corners on each conductive trace and wherein one of said corners forms a capacitor plate.

6. The method of claim 1 wherein said steps of forming a first single open loop conductor and a second single open loop conductor having rounded corners comprises forming each of said rounded corners using a radius of curvature of approximately 0.15 inches.

7. The method of claim 1 wherein said steps of forming a first single open loop conductor and a second single open loop conductor comprises forming each of said conductors using a ratio of width to length of at least 1 to 10 .

8. The method of claim 1 wherein said step of encapsulating said first conductive layer, said dielectric layer and said second conductive layer within plastic layers comprises:

adhesively securing a first plastic layer over said first conductive trace to form a first overlap region;

adhesively securing a second plastic layer over said second conductive trace to form a second overlap region; and sealing together said first overlap region and said second overlap region.

9. The method of claim 1 wherein said step of electrically-coupling said first and second conductive traces by penetrating said dielectric layer at a given location comprises crimping.

* * * * *